US006131494A

United States Patent [19]

Quenneville

[11] Patent Number: 6,131,494

[45] Date of Patent: Oct. 17, 2000

[54] SHOCK ABSORBER ADJUSTMENT TOOL AND METHOD

[76] Inventor: James T. Quenneville, 309 Main St., Whitesboro, N.Y. 13482

[21] Appl. No.: 09/317,183

[22] Filed: May 24, 1999

Related U.S. Application Data

[60] Provisional application No. 60/120,325, Feb. 17, 1999.

[51] Int. Cl.[7] ..... B25B 13/00

[52] U.S. Cl. ..... 81/125.1; 81/176.1

[58] Field of Search ..... 81/125.1, 176.1, 81/176.15, 119, 124.7, 461

[56] References Cited

U.S. PATENT DOCUMENTS

| | | | |
|---|---|---|---|
| D. 103,579 | 3/1937 | McNaught | 81/125.1 |
| 166,492 | 8/1875 | Barnard | 81/176.1 |
| 1,060,005 | 4/1913 | Kistler | 81/176.1 |
| 1,389,955 | 9/1921 | McCracken | 81/176.1 |
| 1,470,528 | 10/1923 | Flentjen | 81/176.1 |
| 1,802,832 | 4/1931 | Priddle | 81/125.1 |
| 4,070,931 | 1/1978 | Florko, Jr. | 81/177 B |
| 5,136,902 | 8/1992 | Ma | 81/119 |
| 5,873,148 | 2/1999 | Arnold | 16/111 R |
| 6,021,596 | 2/2000 | Heuke | 43/19.2 |

FOREIGN PATENT DOCUMENTS

| | | | |
|---|---|---|---|
| 2 257 533 | 8/1975 | France | 81/176.1 |
| 1245365 | 7/1971 | United Kingdom | 81/176.1 |

OTHER PUBLICATIONS

Popular Science, Aug. 1958, p. B11.

No. HD–94455–89 Softail Shock Absorber Spanner sketch, admitted prior art.

*Primary Examiner*—Stephen F. Gerrity
*Assistant Examiner*—Hadi Shakeri
*Attorney, Agent, or Firm*—Nixon & Vanderhye P.C.

[57] ABSTRACT

A single hand tool is utilized to adjust the rear shock absorbers on a motorcycle, such as a Harley Davidson Softail motorcycle, with the motorcycle in a standing position, without requiring jacking or other lifting of the rear wheel of the motorcycle off the ground. The hand tool is a contoured steel plate having a first end serving as a wrench for loosening the lock nut on the shock absorber, and the second end having dowel pins which engage recesses in the shock absorber adjuster plate. The tool has a length short enough to allow the lock nut of the shock absorber to be loosened and tightened without lifting the bike. A handle of the tool between the two ends has finger receiving recesses along both sides.

20 Claims, 3 Drawing Sheets

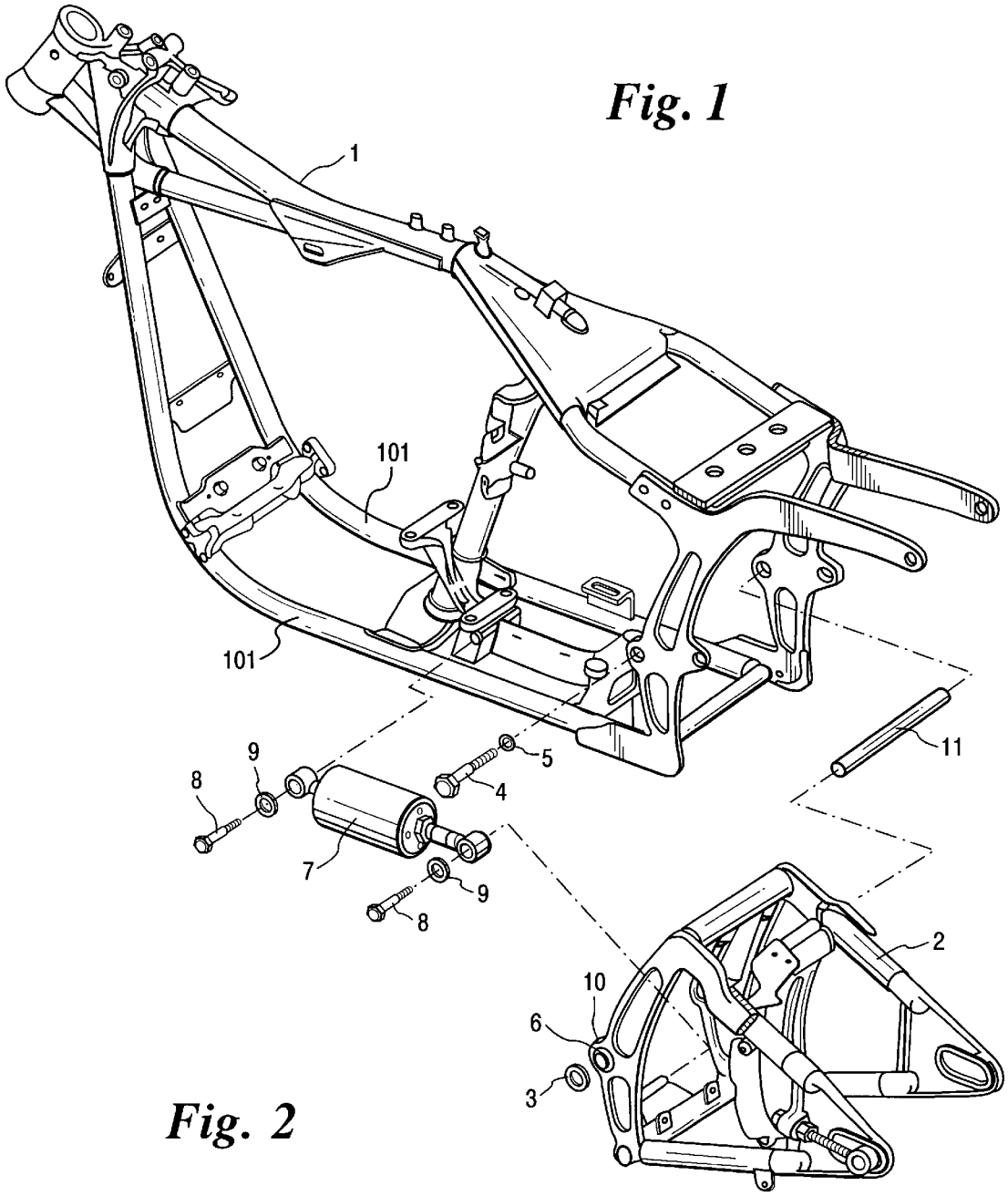
Fig. 1
Fig. 2
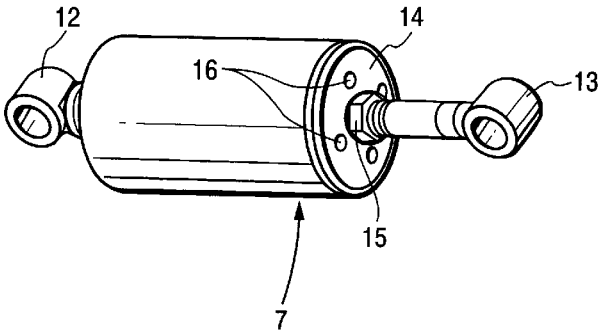

SHOCK ABSORBER ADJUSTMENT TOOL AND METHOD

CROSS REFERENCE TO RELATED APPLICATION

This application is based upon U.S. provisional application Serial No. 60/120,325 filed Feb. 17, 1999.

BACKGROUND AND SUMMARY OF THE INVENTION

Serious motorcycle riders like to adjust the suspension of their bikes to take into account conditions that they expect to encounter, the use to which the bike will be put at any particular time, and just as a matter of preference. For that reason many good quality motorcycles that are on the market are provided with adjustable shock absorbers, typically rear shock absorbers. For example the Harley Davidson Softail model motorcycles have adjustable rear shock absorbers that are considered a very desirable feature of that bike. In a typical adjustment procedure for a Harley Davidson Softail model bike, the user or mechanic needs to lift the bike off of the ground, using a lift, jacks, or other equipment. Lifting is necessary because the standard wrenches used for adjustment are too long to turn the lock nuts on conventional shock absorbers, if the bike is standing. Once the bike is lifted, the lock nut of the shock absorber is loosened with a standard wrench, and then another tool—a spanner—is used to engage cooperating holes in the adjuster plate and to turn the adjuster plate, clockwise for a softer ride, and counterclockwise for a firmer ride. Then the lock nut is again tightened down against the adjuster plate, and the bike lowered back to the standing position.

According to the present invention a shock absorber adjustment tool is provided that greatly simplifies the procedure for adjusting the shock absorbers on motorcycles, and particularly the rear shocks on the Harley Davidson Softail model motorcycles. The tool according to the invention is short enough to allow the lock nut of the shock absorber to be loosened and tightened without lifting the bike (that is while the bike is in the standing position), and has a spanner built in so that the adjustment can be accomplished with a single tool rather than multiple tools. Not only is the method according to the invention thus simplified compared to the prior art, the tool of the invention can be built very inexpensively, and is easy to handle, and is highly effective in performing its desired function.

According to one aspect of the present invention there is provided a method of adjusting a rear shock absorber on a motorcycle, the shock absorber having a lock nut, and an adjuster plate with surface manifestations facilitating rotation thereof; and using a single hand tool having a wrench at a first end thereof and an adjuster plate surface manifestation engaging element on a second end, opposite the first end. The method comprises, without lifting the rear wheel off the ground, and with the motorcycle in a standing position: (a) Loosening the lock nut by engaging the lock nut with the first end of the hand tool and rotating the tool. (b) After (a) rotating the hand tool so that the second end thereof is adjacent the shock absorber. (c) After (b) engaging the shock absorber adjuster plate surface manifestations with the element on the second end of the hand tool to rotate the adjuster plate and thereby adjust the rear shock absorber. (d) After (c) rotating the hand tool so that the first end thereof is again adjacent the shock absorber. And, (e) after (d), engaging the lock nut with the first end of the hand tool and rotating the hand tool to tighten the lock nut and thereby hold the shock absorber in its adjusted position.

In the practice of the method (a) through (e) are preferably practiced using a Harley Davidson Softail motorcycle. Also preferably the surface manifestations are at least two openings spaced about 180° apart, and wherein the hand tool second end has two dowel pins extending therefrom spaced substantially the same distance as the openings in the adjuster plate surface manifestation engaging element; and wherein (c) is practiced by inserting the dowel pins into the openings and then rotating.

The hand tool preferably has a handle between the first and second ends thereof, and in the method (a) through (e) are practiced, in part, by grasping the hand tool handle; for example the hand tool handle preferably has a set of a plurality of finger recesses along each of opposite sides thereof, and (a), (c) and (e) are practiced by grasping the handle with fingers in one set of a plurality of recesses. Typically the motorcycle has two rear shock absorbers, and (a) through (e) are practiced for both of the shock absorbers while the motorcycle is in a standing position, without lifting it off the ground.

According to another aspect of the present invention a hand tool is provided comprising the following components: A contoured steel plate having a first end, a second end, and a center section between the first and second ends. The first end including an opening defined by lock nut engaging surfaces. And, the second end including a recessed surface and a pair of pins extending substantially perpendicularly up from the plate, the pins straddling the recessed surface.

Typically the substantially maximum length from the first to the second end of the contoured plate is no more than 6.45 inches, e.g. about 6.4, or about 6.42 inches. The center section preferably comprises a handle that has first and second sides each with a set of a plurality of finger recesses therealong (e.g. four finger recesses). Typically the pins are slotted spring dowel pins interference fit into openings in the contoured plate, and the contoured plate is a single piece of hot or cold rolled steel with a paint or electroplated finish.

According to yet another aspect of the present invention a hand tool is provided comprising: A contoured steel plate having a first end, a second end, and a center section between the first and second ends. The first end including an opening defined by lock nut engaging surfaces. And, wherein the substantially maximum length from the first to the second end of the contoured plate is no more than about 6.45 inches. The details of the tool are preferably as described above.

It is the primary object of the present invention to provide for the simple adjustment of rear shock absorbers on a motorcycle, particularly a Harley Davidson Softail motorcycle, without requiring lifting of the bike off the ground, and utilizing only one tool. This and other objects of the invention will become clear from an inspection of the detailed description of the invention and from the appended claims.

BRIEF DESCRIPTION OF THE DRAWINGS

FIG. 1 is a exploded perspective view of a rear fork and shock assembly for a Harley Davidson Softail motorcycle;

FIG. 2 is an enlarged perspective view of the shock absorber shown in FIG. 1;

DETAILED DESCRIPTION OF THE DRAWINGS

Figure 3:
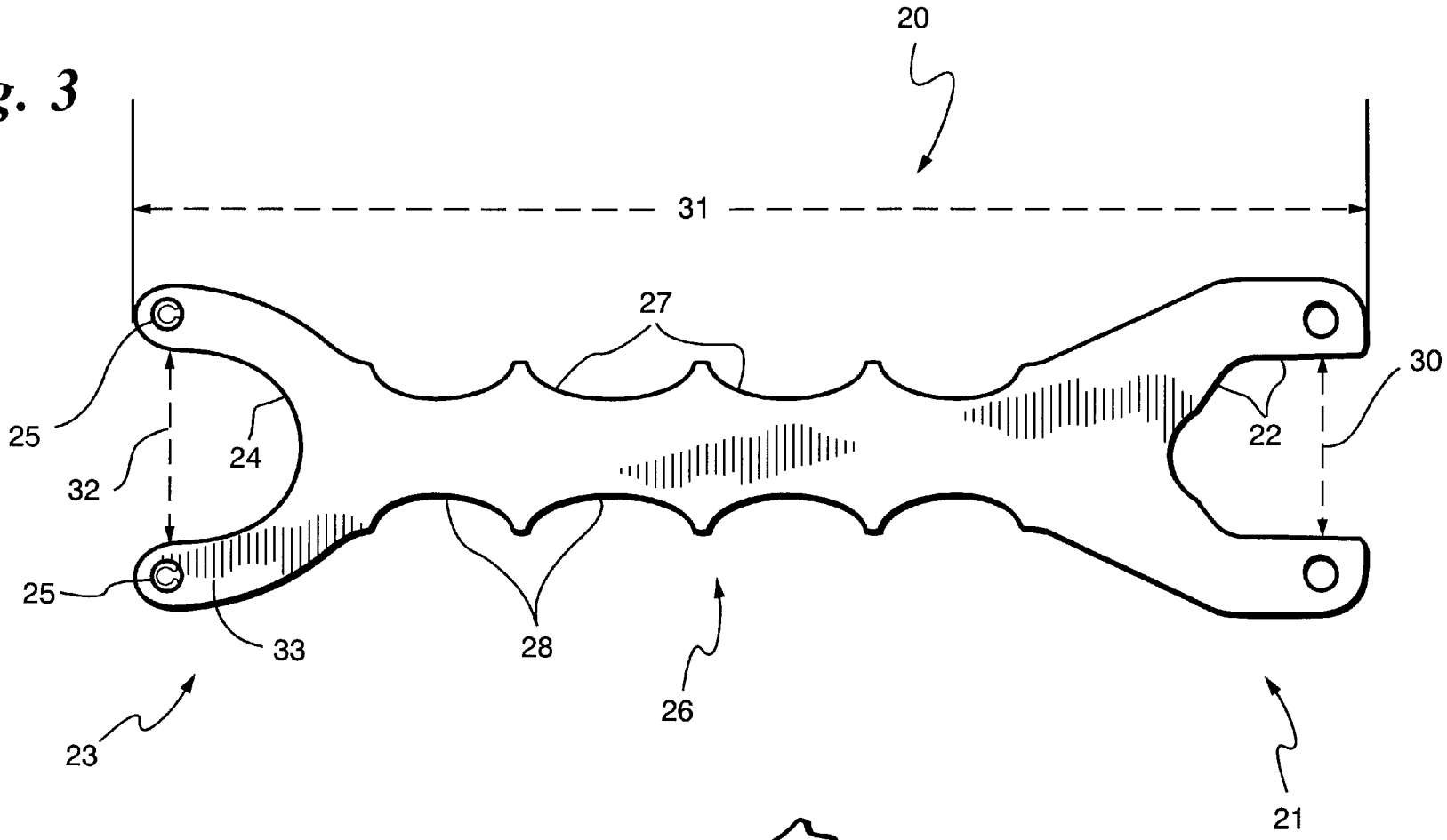
FIG. 3 is a top plan view, substantially actual size, of an exemplary hand tool according to the present invention.

FIG. 1 is an exploded perspective view of the rear fork and shock assembly for the Softail models of Harley Davidson motorcycles, taken directly from the Harley Davidson 1999 owner's manual, and FIG. 2 is a perspective enlarged view of the rear shock absorber of the assembly of FIG. 1. As seen in FIG. 1, the frame of the motorcycle is indicated by reference numeral 1, and the frame has a fork 2 connected by spacers 3, pivot bolts 4, lock washers 5, spherical bearings 6, snap rings 10, and swing axis tube 11 to the frame 1. One of two rear shock absorbers 7 is also seen, the left shock absorber being illustrated in FIG. 1. The shock absorber 7 is connected by bolts 8 and washers 9 to the frame 1 and fork 2. As also clear from FIG. 1, the shock absorbers 7 are mounted substantially between (and substantially parallel to) the bottom frame rails 101 of the frame 1.

Each of the conventional shock absorbers 7 has connections 12, 13 (see FIG. 2) at the opposite ends thereof to cooperate with the bolts 8 to hold the shock absorber 7 onto the fork 2 and the frame 1. The shock absorber 7 also includes an adjuster plate 14 (see FIG. 2) which is held in the position to which it is adjusted by a lock nut 15, and which is adjusted to vary the resistance (e.g. tension) of the shock 7 by inserting an appropriate tool into the openings 16 (typically into two of four openings), or into contact with other adjustment-facilitating surface manifestations, of the adjuster plate 14, and rotating either clockwise or counterclockwise.

Figure 5:
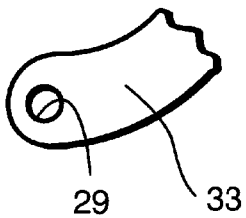
FIG. 5 is a detail view of one of the spanner arms of the tool of FIGS. 3 and 4 prior to the insertion of a dowel pin therein.
Figure 4:
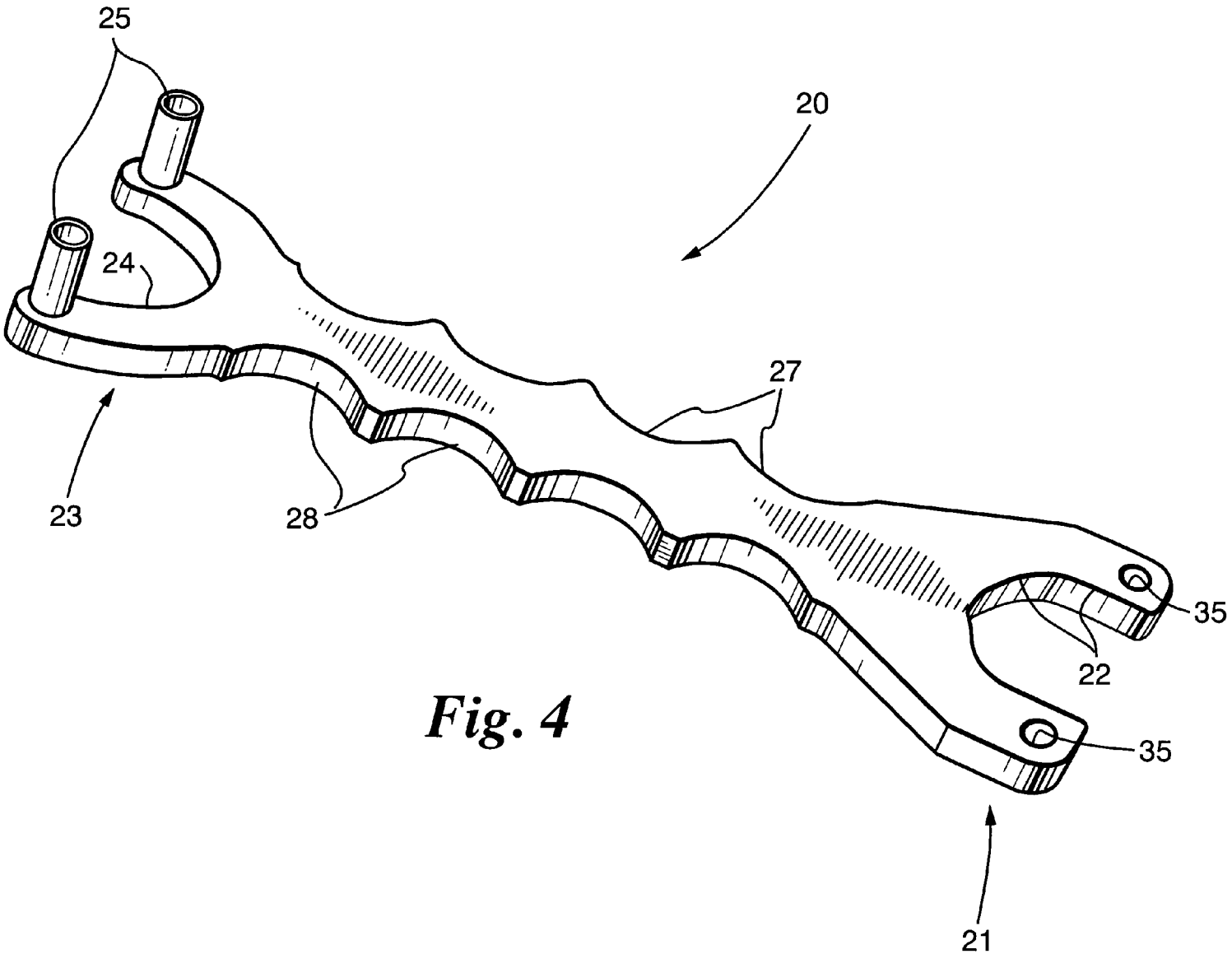
FIG. 4 is a top perspective view of the hand tool of FIG. 3.

FIGS. 3 through 5 show an exemplary embodiment of a shock absorber adjustment tool 20 according to the present invention. The tool 20 has a first end 21 which has an opening defined by wrench surfaces 22 which are adapted to cooperate with the lock nut 15, having the same general shape and dimensions. FIG. 3 is a full size illustration of the preferred embodiment of the tool 20, indicating that the width of the opening between the most remote portions of the surface 22 (that is the distance 30) is about 1.06"±0.01 inches. In the preferred embodiment the length 31 of the tool 20 is less than 6.45 inches, preferably about 6.4 inches, most preferably about 6.42 inches, which is substantially the maximum length that can be provided yet allow the tool 20 to operate properly in the practice of the method of the invention (that is without requiring some sort of lifting of a Harley Davidson Softail model bike).

At the second end of the tool 20 is a spanner 23, which includes a recessed surface 24 which allows the roll pins 25 (or like surface manifestation engaging elements) of the spanner 23 to be placed in openings 16 that are separated about 180° without interfering with the lock nut 15. A spacing 32 (in the embodiment illustrated 1.75 inches from center to center) between the roll pins 25 is substantially identical to the spacing between two about 180° opposite openings 16 (or like surface manifestations) in the adapter plate 14 (see FIG. 2).

Between the ends 21, 23 of the tool 20 is the handle 26, which preferably has finger depressions 27, 28 (preferably four each, as illustrated) on opposite sides thereof to allow the user to get an excellent grip on the tool by placing his or her fingers in the finger recesses 27, 28.

The roll pins 25 are preferably slotted spring dowel pins (e.g. ¼ inch in diameter by ¾ inch long, protruding from the substantially flat surface of tool 20 about ½ inch), e.g. of high carbon steel, each inserted in an opening 29 (see FIG. 5) in a spanner arm 33 during construction, and making an interference fit.

The tool 20 (except for pins 25) may be made from a single piece of cold rolled steel, i.e. a contoured steel plate, with a finish applied, and with the openings 29 drilled. In this case optional openings (seen at 35 in FIG. 4, but not in FIG. 3) may be provided in the wrench end 21 just to bolt down the tool 20 during the machining process. A CNC machining process is preferred. Alternatively the tools 20, in high volume, can be made from hot rolled steel, and a paint or electroplating finish applied.

In the practice of the method according to the invention, without lifting the rear wheel of the motorcycle of which the frame 1 and fork 2 are a part off the ground, and with the motorcycle in the standing position, the user takes the tool 20 and loosens the lock nut 15 on the shock absorber 7 by engaging the lock nut 15 with the first end 21 surface portions 22 of the hand tool 20, and rotating the tool 20. After this, the hand tool 20 is rotated (this can typically be done by the operator with one hand) so that the second end 23 thereof is adjacent the shock absorber 7, and then the shock absorber adjuster plate 14 surface manifestations (e.g. two opposite openings 16) are engaged with the elements (e.g. dowel pins) 25 to rotate the adjuster plate 14 and thereby adjust the rear shock absorber 7, clockwise for a softer ride, and counterclockwise for a firmer ride. Then the hand tool 20 is again rotated (again the operator can typically do this with one hand) so that the first end 21 thereof is again adjacent the shock absorber 7, and then one again engages the lock nut 15 with the surfaces 22 and rotates the hand tool 20 to tighten lock nut 15 and thereby hold the shock absorber 7 adjuster plate 14 in its adjusted position.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of adjusting a rear shock absorber on a motorcycle, the shock absorber having a lock nut, and an adjuster plate with surface manifestations facilitating rotation thereof; and using a single hand tool having a wrench at a first end thereof and an adjuster plate surface manifestation engaging element on a second end, opposite the first end, said method comprising, without lifting the rear wheel off the ground, and with the motorcycle in a standing position:

(a) loosening the lock nut by engaging the lock nut with the first end of the hand tool and rotating the tool;

(b) after (a) rotating the hand tool so that the second end thereof is adjacent the shock absorber;

(c) after (b) engaging the shock absorber adjuster plate surface manifestations with the element on the second end of the hand tool to rotate the adjuster plate and thereby adjust the rear shock absorber;

(d) after (c) rotating the hand tool so that the first end thereof is again adjacent the shock absorber; and (e) after (d), engaging the lock nut with the first end of the hand tool and rotating the hand tool to tighten the lock nut and thereby hold the shock absorber in its adjusted position.

2. A method as recited in claim 1 wherein (a)–(e) are practiced using a motorcycle having bottom frame rails with the rear shock absorber mounted substantially between the bottom frame rails.

3. A method as recited in claim 2 wherein the surface manifestations are at least two openings spaced about 180° apart, and wherein the hand tool second end has two dowel pins extending therefrom spaced substantially the same distance as the openings in the adjuster plate; and wherein (c) is practiced by inserting the dowel pins into the openings and then rotating.

4. A method as recited in claim 3 wherein the hand tool has a handle between the first and second ends thereof, and wherein (c)–(e) are practiced, in part, by grasping the hand tool handle.

5. A method as recited in claim 4 wherein the hand tool handle has a set of a plurality of finger recesses along each of opposite sides thereof; and wherein (a), (c), and (e) are practiced by grasping he handle with fingers in one set of a plurality of recesses.

6. A method as recited in claim 5 wherein the motorcycle has two rear shock absorbers, and wherein (a)–(e) are practiced for both of the shock absorbers while the motorcycle is in a standing position without lifting it off the ground.

7. A method as recited in claim 1 wherein the surface manifestations are at least two openings spaced about 180° apart, and wherein the hand tool second end has two dowel pins extending therefrom spaced substantially the same distance as the openings in the adjuster plate; and wherein (c) is practiced by inserting the dowel pins into the openings and then rotating.

8. A method as recited in claim 1 wherein the hand tool has a handle between the first and second ends thereof, and wherein (c)–(e) are practiced, in part, by grasping the hand tool handle.

9. A method as recited in claim 8 wherein the hand tool handle has a set of a plurality of finger recesses along each of opposite sides thereof; and wherein (a), (c), and (e) are practiced by grasping he handle with fingers in one set of a plurality of recesses.

10. A method as recited in claim 1 wherein the motorcycle has two rear shock absorbers, and wherein (a)–(e) are practiced for both of the shock absorbers while the motorcycle is in a standing position without lifting it off the ground.

11. A hand tool comprising:

a contoured steel plate having a first end, a second end, and a center section between the first and second ends;

said first end including an opening defined by lock nut engaging surfaces; and said second end including a recessed surface and openings separated about 180° and spaced apart defined by an adjuster plate of a shock absorber and a pair of pins located within said openings and extending substantially perpendicularly up from said plate, said pins straddling said recessed surface.

12. A hand tool as recited in claim 11 wherein the substantially maximum length from said first to said second end of said contoured plate is no more than about 6.45 inches.

13. A hand tool as recited in claim 12 wherein said center section comprises a handle that has first and second sides each with a set of a plurality of finger recesses therealong.

14. A hand tool as recited in claim 13 wherein said pins are slotted spring dowel pins interference fit into openings in said contoured plate.

15. A hand tool as recited in claim 11 wherein said contoured plate is a single piece of hot or cold rolled steel with a paint or electroplated finish.

16. A hand tool as recited in claim 11 wherein said center section comprises a handle that has first and second sides each with a set of a plurality of finger recesses therealong.

17. A hand tool as recited in claim 16 wherein said pins are slotted spring dowel pins interference fit into openings in said contoured plate.

18. A hand tool comprising:

a contoured steel plate having a first end, a second end, and a center section between the first and second ends;

said first end including an opening defined by lock nut engaging surfaces; and said second end including a recessed surface and openings separated about 180° and spaced apart defined by an adjuster plate of a shock absorber; and wherein the substantially maximum length from said first to said second end of said contoured plate is short enough to allow a lock nut of a motorcycle having bottom frame rails with the rear shock absorber mounted substantially between the bottom frame rails to be loosened or tightened without lifting the motorcycle rear wheel off the ground and while in a standing position.

19. A hand tool as recited in claim 18 wherein said contoured plate has a maximum length between its first and second ends of about 6.4 inches.

20. A hand tool as recited in claim 19 wherein said center section comprises a handle that has first and second sides each with a set of a plurality of finger recesses therealong.

* * * * *